United States Patent [19]

Chatfield et al.

[11] 4,080,702

[45] Mar. 28, 1978

[54] METHOD FOR OBTAINING HOLLOW ARTICLES

[75] Inventors: Phillip A. Chatfield, West Haven; Damian V. Gullotti, Cheshire, both of Conn.

[73] Assignee: Olin Corporation, New Haven, Conn.

[21] Appl. No.: 778,040

[22] Filed: Mar. 16, 1977

[51] Int. Cl.[2] ..... B21D 26/02

[52] U.S. Cl. ..... 29/157.3 V

[58] Field of Search ..... 29/157.3 V, 157.3 C, 29/157.3 R

[56] References Cited

U.S. PATENT DOCUMENTS

| | | | |
|---|---|---|---|
| 2,828,533 | 4/1958 | Fromson | 29/157.3 V |
| 3,334,398 | 8/1967 | Middleton | 29/157.3 V |
| 3,728,778 | 4/1973 | Middleton | 29/157.3 V X |

*Primary Examiner*—Milton S. Mehr

*Attorney, Agent, or Firm*—Robert H. Bachman, Robert A. Dawson

[57] ABSTRACT

The disclosure teaches a method for the manufacture of hollow articles useful as heat exchangers including the steps of rolling together two sheets of metal with at least one metal tube sandwiched therebetween to form a bonded assembly. The metal tube is subsequently expanded by the introduction of pressure therein to form an internal passageway.

9 Claims, 6 Drawing Figures

METHOD FOR OBTAINING HOLLOW ARTICLES

BACKGROUND OF THE INVENTION

The present invention relates to the preparation of expanded pressure welded passageway panels. More particularly, the present invention relates to the preparation of metal panels of the foregoing type having utility in heat exchange applications wherein the heat exchange medium is circulated through the passageways.

A commonly used and efficient type of heat exchange unit for a variety of purposes is formed from a plurality of superimposed sheets of metal having internally disposed therebetween one or more conduits or tubes to carry a heat exchange medium. According to one known method of manufacture, as illustrated in U.S. Pat. No. 2,690,002, this type of heat exchange unit may be readily manufactured to provide if desired a great multiplicity of tubes in a metal panel in virtually any desired pattern. This method involves the application of a suitable predetermined pattern of weld inhibiting material corresponding to desired passageways in the final article between component sheets and pressure welding all adjoining areas except those separated by the weld inhibiting material. This forms a unified composite panel which is subsequently inflated along the unwelded areas to erect tubes integral with the resultant panel.

The sheet-like structure having internal hollow passageways formed in accordance with the foregoing process is well adapted for use as a heat exchanger wherein a heat exchange medium can be circulated throughout the structure in the internal passageways. The panel may naturally be provided with the necessary connections for the circulation of the heat exchange medium. As can be appreciated, these connections can vary in number and displacement to suit the desired end use of the heat exchange panel. For example, U.S. Pat. No. 2,822,151, issued Feb. 4, 1958, discloses a plate-like heat exchanger of the foregoing type provided with a single connection for both entry and exit of fluid, and possesses particular utility for the circulation of refrigerants. Correspondingly, copending application Ser. No. 573,953, the disclosure of which is incorporated herein by reference, illustrates a heat exchange structure of the foregoing type provided with longitudinally opposed connections comprising, respectively, inlet and outlet portions provided to enable the continuous flow of heat exchange medium transporting absorbed energy.

Heat exchanger panels of the foregoing type have found considerable utility in solar energy recovery systems. It is desirable, however, to provide improved panels similar to those discussed above and methods for obtaining same particularly for use in solar energy recovery systems. Thus, for example, panels formed by the foregoing process are frequently made of aluminum. Corrosion problems in these aluminum panels require the use of an inhibited heat transfer fluid to provide satisfactory life. Aluminum panels also require special connection procedures and special skills of installation. Panels made entirely of copper or copper alloys overcome these problems, but suffer from the disadvantage of considerably increased cost.

Another process used to make satisfactory panels for solar energy recovery systems involves the use of copper tubing soldered to flat copper plates. The cost of both materials and fabrication is high for such panels.

Accordingly, it is a principal object of the present invention to provide an improved method for the manufacture of hollow articles useful as heat exchangers, particularly in solar energy recovery systems, and also an improved panel obtained thereby.

It is a further object of the present invention to provide an improved method and panel as aforesaid which is inexpensive to prepare and which may be readily used with a variety of different metals.

Further objects and advantages of the present invention will appear hereinafter.

SUMMARY OF THE INVENTION

In accordance with the present invention, the foregoing objects and advantages may be readily obtained. The present invention comprises a method for the manufacture of hollow articles useful as heat exchangers which comprises: providing a first and second sheet of metal in superposed relationship; forming an assembly by placing at least one metal tube between said first and second sheets corresponding to a predetermined configuration of fluid passageways, said tube having a weld inhibiting material therein; pressure welding said assembly in the areas thereof not separated by weld inhibiting material; and expanding said assembly in the areas separated by weld inhibiting material by the introduction of fluid pressure therein.

It can be apppreciated that the process of the present invention is quite versatile and that a variety of materials may be utilized for either the sheet components or the tube components. In the preferred embodiment, the sheet components are formed of an aluminum or aluminum alloy material and the tube components are formed of a copper or copper alloy material in order to provide the advantages of both of these materials. In the preferred embodiment a plurality of metal tubes are placed between the sheets spaced from each other in a predetermined, spaced relationship, with each of said tubes being subsequently expanded by the introduction of pressure therein. A panel of this type is particularly useful as a solar panel in solar energy recovery systems. In the expansion step the trailing end of said tubes are clamped shut and pressure is introduced into the tubes at the leading edge. Headers may be connected to said tubes at the leading and trailing edges thereof as by soldering.

DETAILED DESCRIPTION OF PREFERRED EMBODIMENTS

Figure 1:
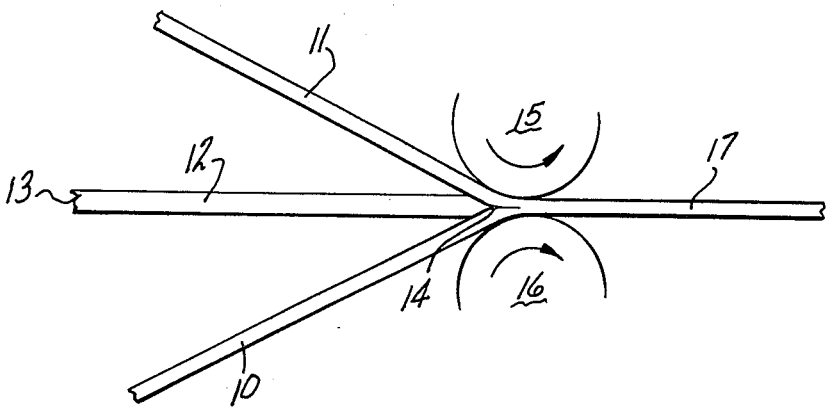
FIG. 1 schematically depicts pressure welding the components of the present invention.

Referring to the drawings, FIG. 1 schematically depicts the formation of the bonded assembly of the present invention. In accordance with FIG. 1 a first sheet of metal 10 and a second sheet of metal 11 are provided. At least one metal tube 12 is placed between the first and second sheets corresponding to a predetermined configuration of fluid passageways to form an assembly 14. The tube 12 has a weld inhibiting material 13 therein substantially throughout the extent thereof. The assembly 14 is pressure welded as by feeding the assembly through rolls 15 and 16 to reduce the thickness thereof and to form a bonded assembly or pressure welded article 17 wherein the components thereof are pressure welded in the areas thereof not separated by weld inhibiting material. Naturally, if desired, a plurality of sheets 10 and/or 11 may be employed based on the characteristics desired in the final product wherein the sheets may be of similar or dissimilar compatible metals. In the preferred embodiment indefinite length strip is utilized which is subsequently sheared to desired length. Naturally, the process may be conducted as a batch-type procedure where sheets are used generally corresponding to final panel length.

FIG. 1 schematically shows the formation of the bonded panel by feeding the components thereof simultaneously between rolls 15 and 16. As is apparent, the present invention contemplates such simultaneous feeding of components or other variants thereof that will be obvious to one skilled in the art. Thus, tube 12 may be preliminarily spot welded to the surface of the first sheet of metal 10 in a predetermined configuration. Alternatively, tube 12 may simply be superimposed on the surface of sheet 10 and held thereon by means of tension. In the preferred embodiment, a plurality of tubes are utilized, such as, for example, three tubes shown in FIG. 2. Naturally, any number of tubes may be used spaced from each other in a predetermined spaced relationship such as exemplified in FIG. 2. In the preferred embodiment, the metal sheets are aluminum or aluminum alloys and the tubes are copper or copper alloys. Also, the procedure schematically depicted in FIG. 1 may be employed on an indefinite length of material or on discrete sections corresponding to the desired panel length, as indicated above. The preferred embodiment utilizes an indefinite length of material, although one can also use discrete sections since this avoids subsequent trimming operations.

Figure 2:
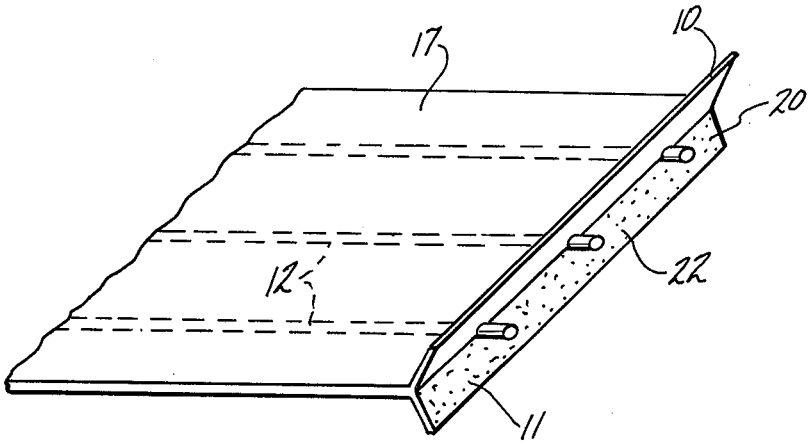
FIG. 2 is a perspective view of the bonded assembly showing the leading edge thereof peeled back to expose the tubes.
Figure 4:
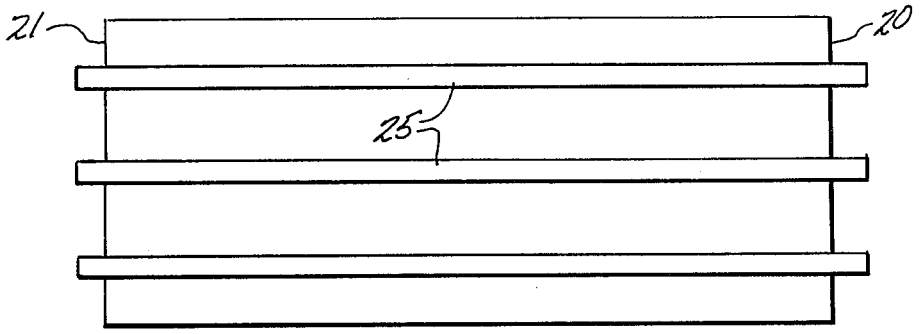
FIG. 4 is a top view showing the bonded panel with tubes expanded.
Figure 5:
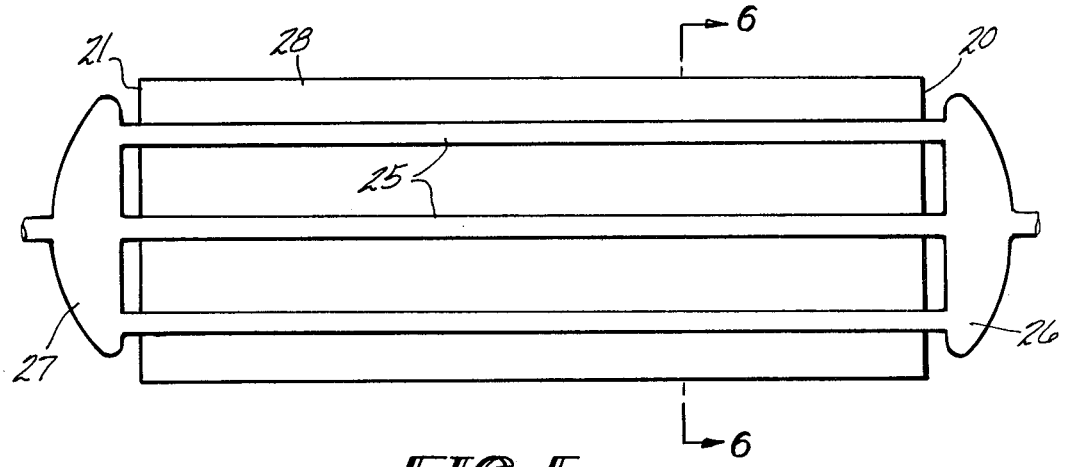
FIG. 5 is a top view showing the panel of FIG. 4 with headers attached.

In the preferred embodiment, the panel has a leading edge 20 and a trailing edge 21, see FIGS. 4 and 5. Preferably, additional weld inhibiting material 22 is placed between the first and second sheets of metal prior to bonding at the leading edge thereof so that welding of the sheets is precluded at this point. Hence, sheets 10 and 11 may be peeled back after the pressure welding step as shown in FIG. 2 to expose the tubes for subsequent expansion. The peeled back portion may be subsequently trimmed. The same procedure is preferably employed on the trailing edge to expose both ends of the tubes. Alternatively, the tube length may be greater than the sheet length taking care to insure that the longer tubes are clearly exposed after bonding.

Figure 3:
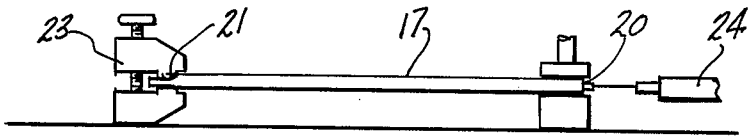
FIG. 3 is a schematic view showing the expansion of the tubes.
Figure 6:
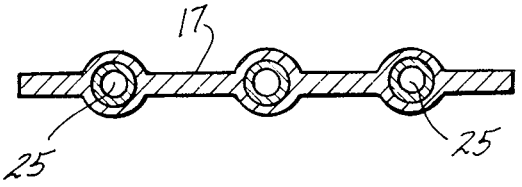
FIG. 6 is a cross-sectional view along the lines 6—6 of FIG. 5.

The expansion step is shown schematically in FIG. 3 wherein the trailing edge 21 of said panel 17 is clamped shut by any desired means, as by clamp 23 and pressure is introduced into tubes 12 by means of fluid pressure inflation needle 24 which expands the copper tubes to form expanded passageways 25 clearly shown in FIG. 6. In a preferred embodiment, all tubes are expanded simultaneously by the use of an inflation apparatus having a plurality of nozzle attachments (not shown). Naturally, the tubes may be inflated one at a time, if desired.

After the formation of bonded panel 17 and expanded tubes 25, one may conveniently attach headers 26 and 27 to both ends of the panel to form completed heat exchanger 28 shown in FIG. 5.

Naturally, the process of the present invention contemplates numerous variations therein. As indicated hereinabove, the preferred operation utilizes aluminum sheets 10 and 11 and copper tube 12. Naturally, a variety of other metals may be used depending upon particular end use. For example, one can conveniently utilize virtually any like metal sheet and tube, such as aluminum or aluminum alloy sheet and similar tube or copper or copper alloy sheet and similar tube. Other representative combinations include copper sheet or tube with ferrous sheet or tube and zinc sheet or tube with ferrous sheet or tube.

The bonding rolling operation, which may if desired be performed hot or cold, normally produces an average area reduction in thickness of from 40 to 70%, with naturally the aluminum strip being reduced a greater extent than the copper tube. For example, where an average 60% area reduction is utilized, the aluminum strip would be reduced about 70% and the copper tube would be reduced about 50%. Generally, the ratio of the reductions in the copper and aluminum components would be the inverse of the ratio of the ductility of the copper and aluminum components. At the exit of the mill, a metallurgical bond would exist at all metal interfaces not protected by weld inhibiting material. In order to help maintain flatness, foretension may be applied to the exiting strip to overcome the unequal reductions occurring at the width of the assembly. After bonding, a heat treatment operation, or additional cold reductions, may be given to the bonded assembly to adjust the mechanical properties of the composite to desired levels. If an indefinite length of material is prepared by the bonding operation, the bonded strip would then be sheared to the desired length to form panels. A plurality of strips of weld inhibiting material would preferably be applied so that the tubes may be exposed at a leading and trailing edges of the sheared panel in a manner similar to that shown in FIG. 2

Any suitable aluminum or copper material may be employed in the process of the present invention. The aluminum alloy shown should preferably be high in thermal conductivity and sufficiently workable to facilitate bonding, such as aluminum alloys of the 1000, 3000 or 5000 series. If structural rigidity is an important factor in the final panel, age hardenable aluminum alloys, such as of the 6000 or 7000 series, can be used. These alloys should be bonded in the annealed condition. A subsequent solution heat treatment and aging operation is naturally required to take advantage of these type alloys. The chosen copper alloy should preferably be commercially available in tube form and workable enough to allow bonding. Solderability and corrosion resistance should also be high. Illustrative copper alloys that may be employed include the copper-nickel alloys and CDA Alloys 110 and 194.

The gages of strip and tubing employed should naturally minimize the amount of the expensive copper component, but still maintain the desired characteristics of strength, corrosion resistance and solderability. Bonding reductions should naturally depend on the alloys chosen, but should not be less than 40% in order to insure a good bond. The upper limit is generally below 70% available reduction, but depends on the workability of the alloys employed and the desired mechanical properties of the finished product.

Naturally, one may utilize first and second sheets of metal of the same or unequal thicknesses. Also, if desired, one may inflate the tubes into a die in order to obtain exact inflated dimensions. Alternatively, one may use profiled bonding rolls or profiled sheet or sheets to equalize reduction across the entire strip. One may, if desired, use composite sheets or tubes in order to achieve particularly advantageous characteristics.

The process of the present invention may provide for the production of panels with corrosion resistance, strength and post bonding fabricability superior to conventional materials, such as pressure welded all aluminum panels, with cost and weight below that of pressure welded all copper panels. Panels produced by this process are more efficient and less expensive than panels produced by conventional bonding techniques and may be fabricated so that they can be readily interfaced into conventional plumbing systems without specialized techniques. Particularly, the present panels eliminate the problem of crevice corrosion which may be encountered in pressure welded panels.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. A method for the manufacture of hollow articles useful as heat exchangers which comprises: providing a first and second sheet of metal in superposed relationship; forming an assembly by placing at least one metal tube between said first and second sheets corresponding to a predetermined configuration of fluid passageways, said tube having a weld inhibiting material therein; pressure welding said assembly in the areas thereof not separated by weld inhibiting material; and expanding said assembly in the areas thereof separated by weld inhibiting material by the introduction of fluid pressure therein, wherein said first sheet, second sheet and tube have a leading edge and a trailing edge with the trailing edge of said tube being clamped shut during said expansion step, wherein weld inhibiting material is placed between said first and second sheets at the leading edge thereof with said sheets being peeled back after said pressure welding step to expose said tube.

2. A method according to claim 1 wherein a plurality of metal tubes are placed between said sheets spaced from each other in a predetermined, spaced relationship, with each of said tubes being subsequently expanded by the introduction of pressure therein.

3. A method according to claim 2 wherein the trailing edges of said tubes are clamped shut during the expansion step and wherein the sheets are peeled back after pressure welding to expose the leading edge of said tubes.

4. A method according to claim 2 wherein said first and second sheet is aluminum or an aluminum base alloy and wherein said tubes are copper or copper base alloys.

5. A method according to claim 2 wherein weld inhibiting material is placed between said first and second sheets at the leading edge and trailing edge thereof and wherein both the leading edge and trailing edge of said sheets are peeled back after said pressure welding step to expose said tubes.

6. A method according to claim 5 wherein headers are connected to said tubes at the leading and trailing edges thereof.

7. A method according to claim 2 wherein said hollow article is a solar panel.

8. A method according to claim 1 wherein said first and second sheets are of different metals.

9. A method according to claim 1 wherein said first and second sheets have different thicknesses.

* * * * *